US007093747B1

(12) United States Patent
Marchese

(10) Patent No.: US 7,093,747 B1
(45) Date of Patent: Aug. 22, 2006

(54) MAIL BOX COVER ACCESS AND INSERT FOR MASONRY MAIL BOXES

(76) Inventor: Raymond Marchese, 1225 Four Winds Ct., Niles, OH (US) 44446

( * ) Notice: Subject to any disclaimer, the term of this patent is extended or adjusted under 35 U.S.C. 154(b) by 0 days.

(21) Appl. No.: 11/299,549

(22) Filed: Dec. 13, 2005

(51) Int. Cl.
*B65G 11/04* (2006.01)

(52) U.S. Cl. ..... 232/45; 232/38; 232/39

(58) Field of Classification Search ..... 232/45, 232/47, 1 C, 38, 39, 17; D99/29–32; 248/146
See application file for complete search history.

(56) References Cited

U.S. PATENT DOCUMENTS

| | | | | | |
|---|---|---|---|---|---|
| 4,375,869 | A | | 3/1983 | Hatch | |
| 4,875,622 | A | * | 10/1989 | Lents | 232/39 |
| 5,035,356 | A | | 7/1991 | Granger | |
| 5,346,125 | A | | 9/1994 | Critzer, Sr. | |
| 5,361,977 | A | * | 11/1994 | Ogrodnick, Jr. | 232/39 |
| 5,524,818 | A | * | 6/1996 | Patry et al. | 232/35 |
| 5,938,113 | A | * | 8/1999 | Kim | 232/47 |
| 5,946,838 | A | | 9/1999 | Lanoue | |
| 5,992,736 | A | * | 11/1999 | Parker | 232/17 |
| 6,109,519 | A | * | 8/2000 | McClure | 232/17 |
| 6,123,257 | A | * | 9/2000 | Guidicy | 232/17 |
| 6,234,387 | B1 | * | 5/2001 | Cuthbert et al. | 232/29 |
| 6,244,505 | B1 | * | 6/2001 | Grimes et al. | 232/47 |
| 6,347,737 | B1 | * | 2/2002 | Madruga | 232/47 |
| 6,375,071 | B1 | * | 4/2002 | Kim | 232/47 |
| 6,644,543 | B1 | * | 11/2003 | Cox et al. | 232/47 |
| 2005/0067480 | A1 | | 3/2005 | Toussant et al. | |

* cited by examiner

*Primary Examiner*—William L. Miller
(74) *Attorney, Agent, or Firm*—Harpman & Harpman

(57) ABSTRACT

A mail box access replacement cover assembly for use on existing and new masonry mounted mail boxes having a mail box and newspaper insert. A two-part adjustable assembly is secured on the masonry support surface aligned to overlie the mail box and newspaper tube openings respectively. A decorative replacement access door for the mail box and paper receiving tube are respectively secured to the assembly by decorative cover fill plate selectively positioned therebetween.

10 Claims, 6 Drawing Sheets

MAIL BOX COVER ACCESS AND INSERT FOR MASONRY MAIL BOXES

BACKGROUND OF THE INVENTION

1. Technical Field

This invention relates to masonry mounted mail boxes and specifically mail box access doors and newspaper tube receptacles typically found therein.

2. Description of Prior Art

Prior art masonry mounted mail boxes are usually formed from bricks or stone in the form of a free standing pillar with a regulation metal mail box inserted therein. Additionally, a newspaper receiving tube is provided below the mail box insert. Heretofore such standard metal mail box inserts rust and eventually fail as well as being unsightly over time. Aluminum and plastic mail boxes are available for new construction and mail box covers have been developed to provide a decorative overlay for a standard mail box, see U.S. Pat. Nos. 4,375,869, 5,035,356, 5,346,125, 5,946,838 and 6,123,257 and U.S. Patent Publication 2005/0067480 A1.

In U.S. Pat. Nos. 4,375,869, 5,035,356, 5,346,125 and 5,946,838 a variety of mail box covering assemblies are shown that provide for a number of different structural and decorative ways to cover a standard mail box such as wood slats and/or removable designer decorative panels see in U.S. Pat. Nos. 4,375,869 and 5,346,125.

A masonry mail box assembly with a replaceable insert can be seen in U.S. Pat. No. 6,123,257 which provides for a liner within a masonry support with a mail box inserted therein.

U.S. Patent Publication 2005/0067480 discloses a removable decorative mail box cover for the door thereof.

SUMMARY OF THE INVENTION

A mail box and newspaper tube access replacement assembly for use on masonry mounted mail boxes. A two-part assembly is secured onto the masonry support structure providing a new mail box access door which can be adjusted to size. A custom decorative door can be used replacing existing damage or rusted doors as well as new masonry mail box constructions with the use of a non-corrosive mail box insert during construction.

DETAILED DESCRIPTION OF THE INVENTION

Figure 1:
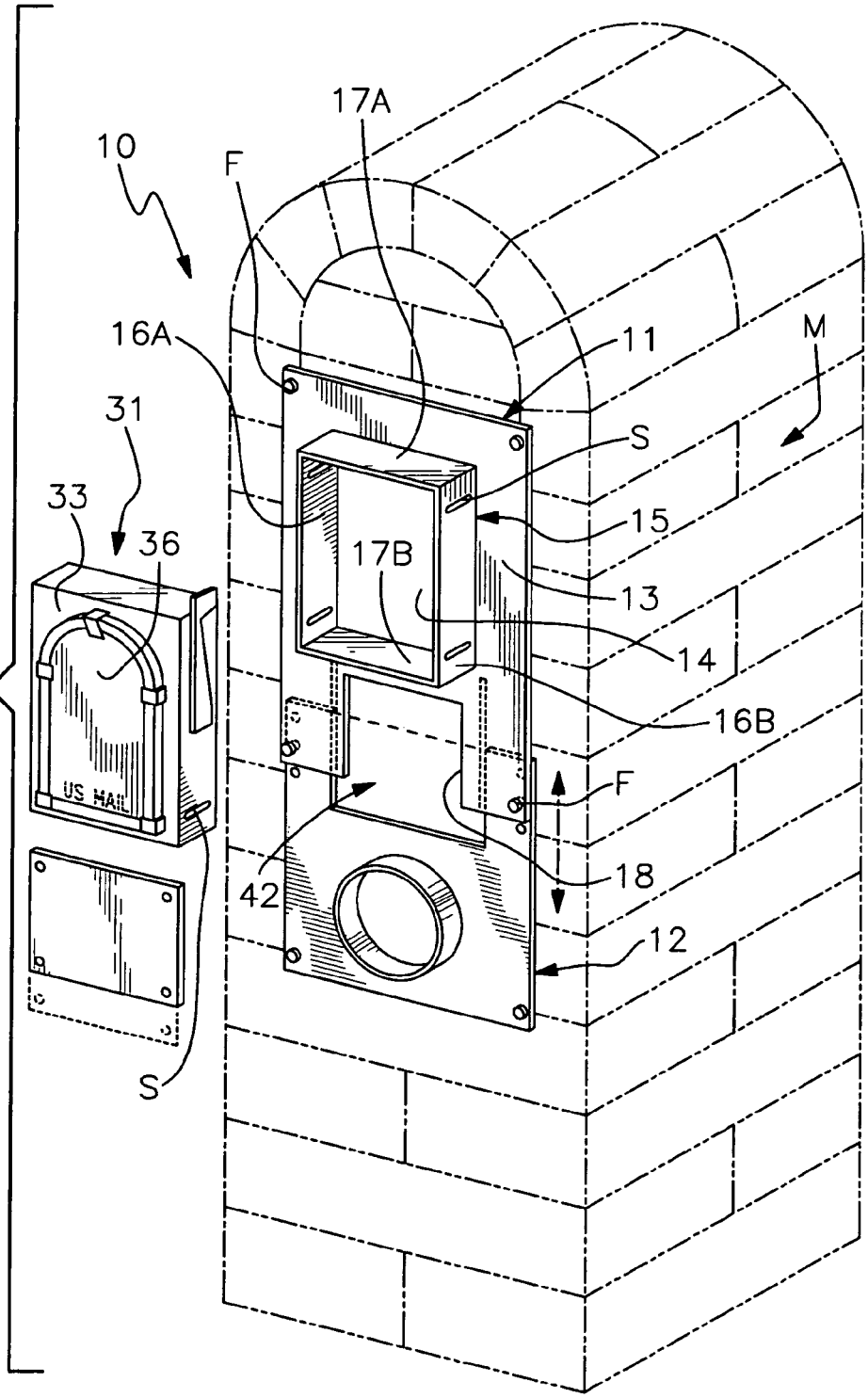
FIG. 1 is an exploded perspective view of the mail box access assembly on a masonry mail box support structure.
Figure 2:
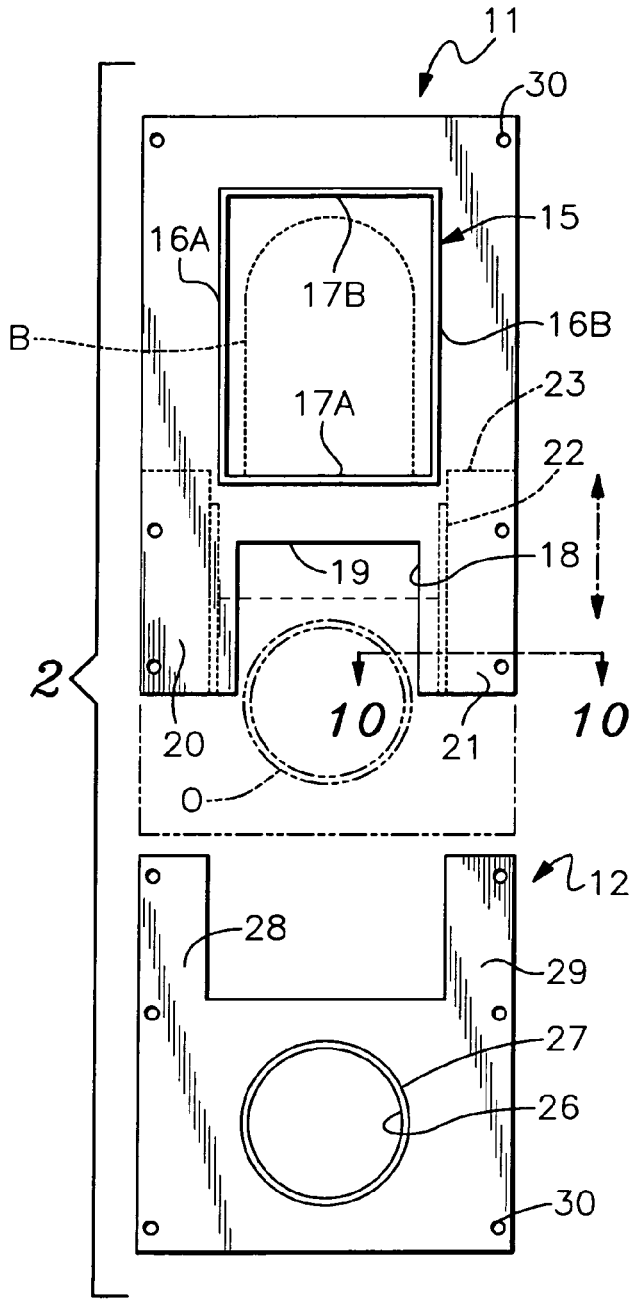
FIG. 2 is a front elevational view of the mail box and newspaper tube mounting frame positioned thereon.
Figure 3:
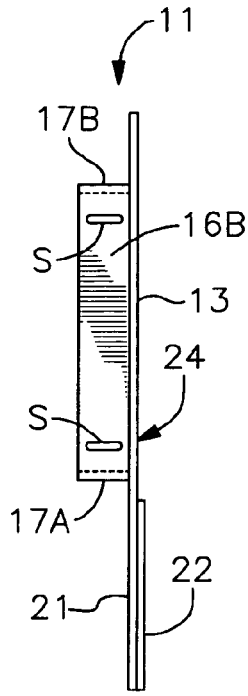
FIG. 3 is a side elevational view of the mail box mounting frame portion.
Figure 4:
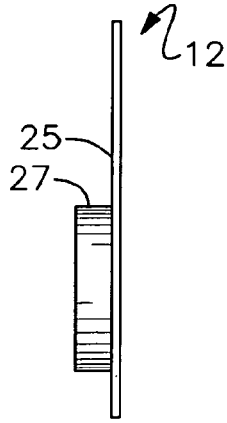
FIG. 4 is a side elevational view of the newspaper mounting tube frame portion.
Figure 6:
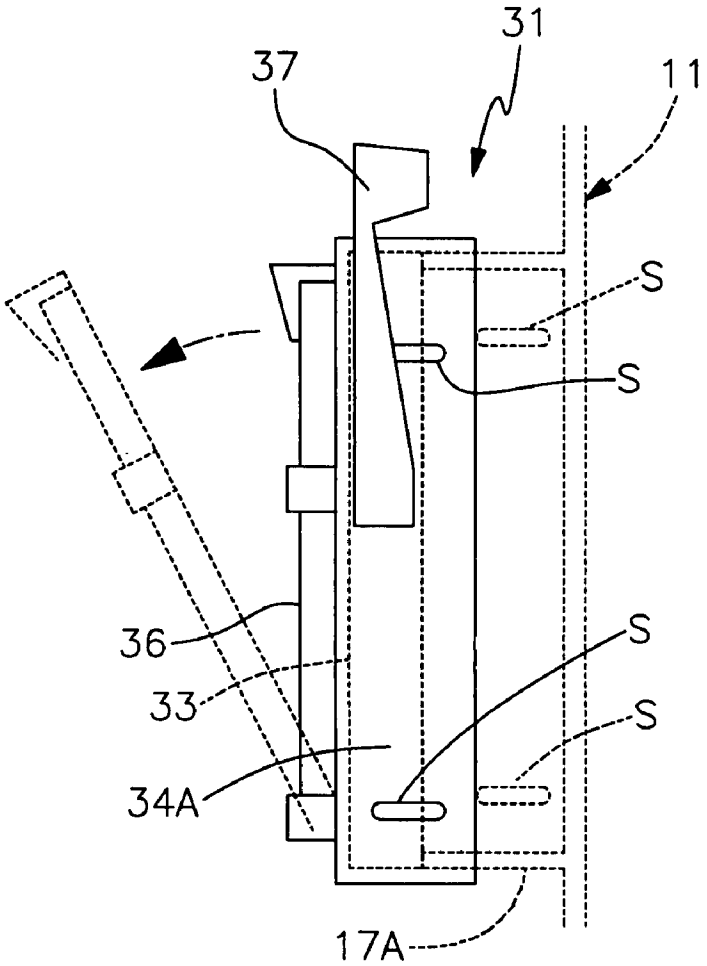
FIG. 6 is a side elevational view thereof.
Figure 5:
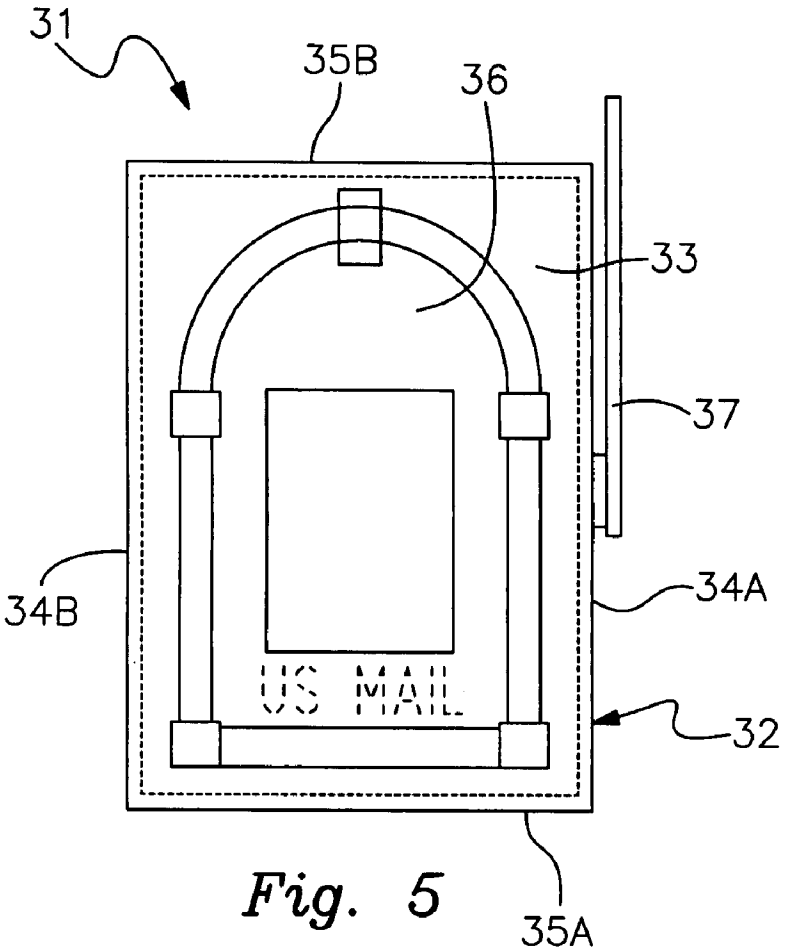
FIG. 5 is a front elevational view of a decorative access door and frame.

Referring now to FIGS. 1–4 of the drawings, a mail box and paper tube access assembly 10 can be seen having a mail box portion 11 and a paper receiving tube portion 12. The mail box portion 11 has a base plate 13 with a generally rectangular cut-out at 14 defining an opening therein. An upstanding registration flange 15 extends around the opening having oppositely disposed sidewalls 16A and 16B with interconnected top and bottom walls 17A and 17B therebetween. A notch 18 is formed inwardly along the bottom edge 19 of the base plate 13 defining a pair of oppositely disposed adjustment arms 20 and 21, best seen in FIG. 2 of the drawings. A guide rib 22 extends from the respective arms 20 and 21 inset from the notch 18 to a point therebeyond at 23 on the back surface 24 thereof, best seen in FIG. 2 of the drawings in dotted lines and in FIGS. 3 and 4 in solid lines.

The paper receiving tube portion 12 has a mounting plate 25 with a circular cut-out at 26 having an upstanding annular flange 27 thereabout. A pair of elongated adjustment tabs 28 and 29 extend from the mounting plate 25 for overlying adjustable registration against the respective areas 20 and 21 of the base plate 13 and hereinbefore described guide ribs as seen in dotted lines in FIG. 1 of the drawings.

Both of the mail box portion 11 and paper receiving portion 12 have a plurality of mounting apertures 30 therein to afford the use of fasteners (not shown) for securing same to the surface S of a masonry mail box support element M, shown in broken lines in FIG. 1 of the drawings.

A mail box door assembly 31 has a generally rectangular mounting frame 32 having a centrally apertured door mounting plate 33 with parallel spaced side flanges 34A and 34B and interconnecting respective end flanges 35A and 35B extending therefrom.

An interchangeable access door 36 is pivotally secured to the door mounting plate 33 so as to be registerably engaged thereon when in closed position, as illustrated in FIG. 1 of the drawings.

It will be noted that the inner dimension defined between the respective side flanges 34A and 34B and end flanges 35A and 35B is of a greater dimension than that of the outer surface dimension of the hereinbefore described side, top and bottom walls 16A and 16B and 17A and 17B respectively so as to be slidably engaged and adjustably positioned thereon. This arrangement affords effective depth adjustment of the door assembly 31 in relation to the mail box portion 11 to accommodate different applications as may be encountered in the field.

A plurality of elongated mounting slots S are formed on the respective walls 16A and 16B and overlying flanges 17A and 17B for aligned registration with one another providing for selective depth adjustment engagement by fasteners F (not shown) as noted above.

A single flag 37 is provided that is pivotally secured to the sidewall 16A providing the traditional mail delivery/pick-up functionality as is well known by those skilled in the art.

Figure 7:
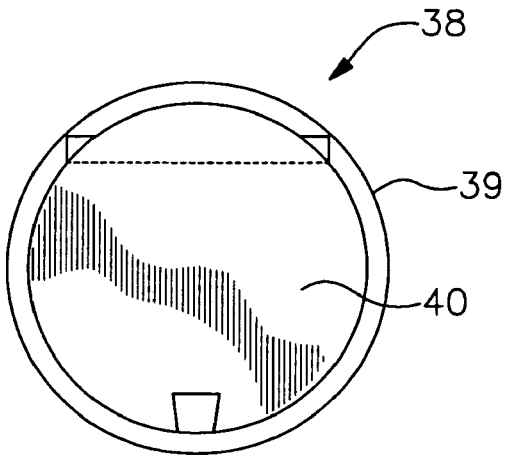
FIG. 7 is a front elevational view of a paper tube door and frame.
Figure 8:
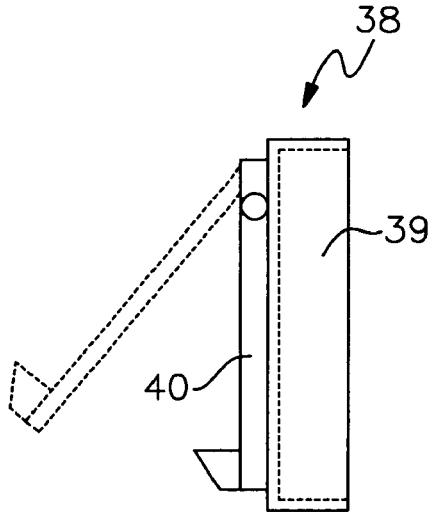
FIG. 8 is a side elevational view thereof.
Figure 11:
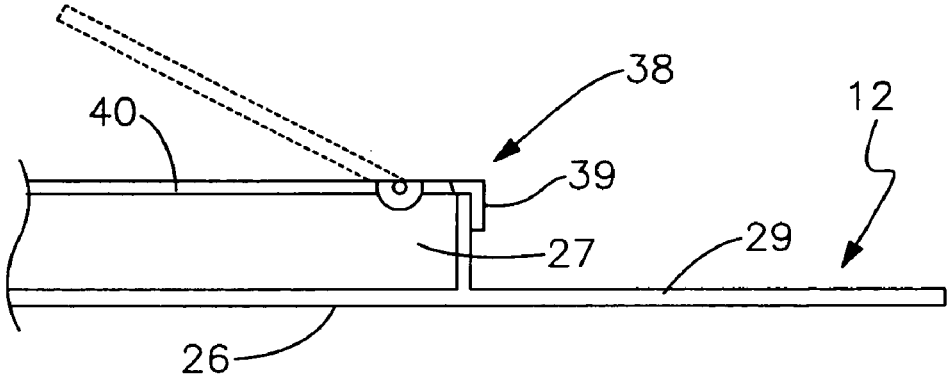
FIG. 11 is a partial enlarged side elevational view of the paper tube receiving door assembly.
Figure 12:
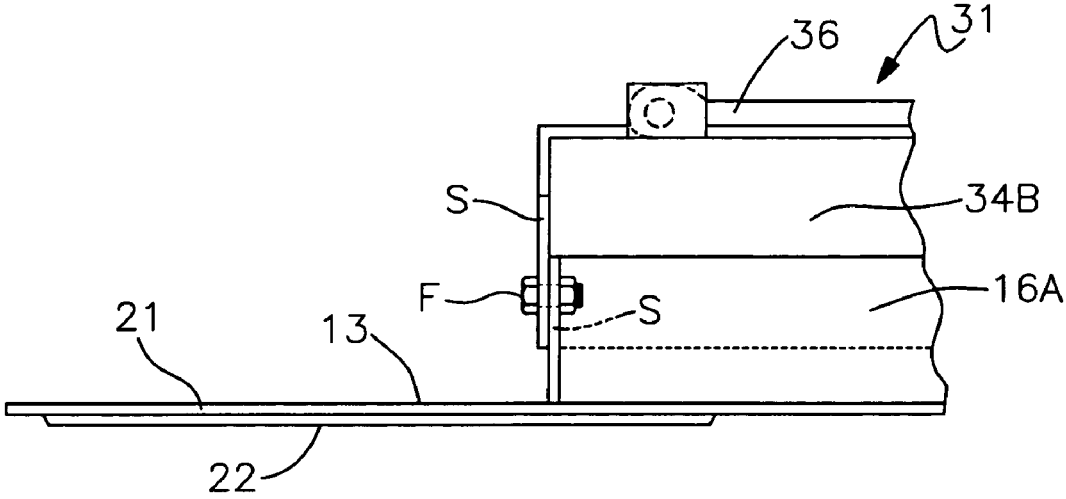
FIG. 12 is a partial enlarged side elevational view of the mail box door assembly.

An auxiliary paper tube receiving access retainment portal cover assembly 38 can be seen in FIGS. 7, 8 and 11 of the drawings wherein an annular mounted band 39 has a pivotally secure closure 40 thereon. This optional closure 40 acts as a newspaper (not shown) restraint device as well as protection from the natural elements such as wind driven rain and snow. It will also be evident that the annular shape of the paper receiving tube portion 12 can be modified to rectangular which is also used within the industry.

Referring now back to FIG. 1 of the drawings, the mail box and paper tube assembly 10 of the invention can be seen positioned on the masonry support column M. The paper receiving tube portion 12 is preferably positioned on the masonry support column M and aligned over the existing paper tube opening O and secured in place by fasteners F, as noted. The mail box portion 11 is then slidably positioned thereover and aligned with the mail box opening B by the respective adjustment arms 20 and 21 overlying the adjacent tabs 28 and 29 via guide ribs 22, shown in dotted lines.

Once properly aligned, the respective mail box portion 11 and paper receiving tube portion 12 are secured permanently by fasteners F to the masonry mail box support column M.

It will be well understood that alternate mounting sequence can be achieved by a slight reconfiguration of the guide ribs so that the mail box portion 12 can be initially positioned over the mail box opening B and then the respective paper receiving tube portion 12 be slidably engaged thereover in a reverse fashion which may be warranted in certain applications as would be evident in the field.

Figure 9:
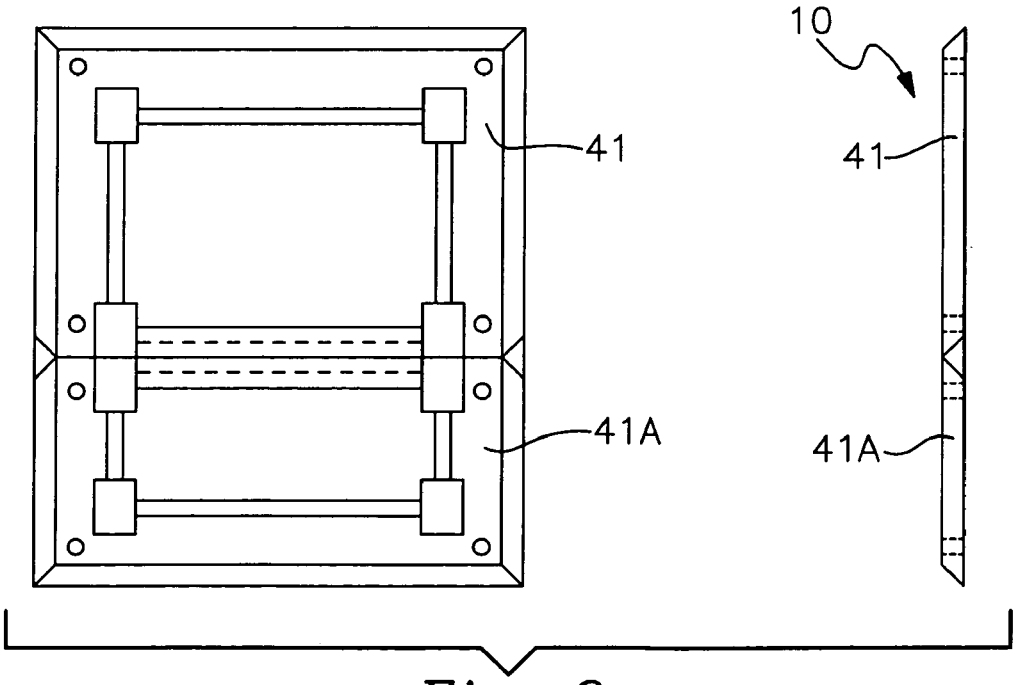
FIG. 9 is a front and side elevational view of a decorative cover plate.
Figure 10:
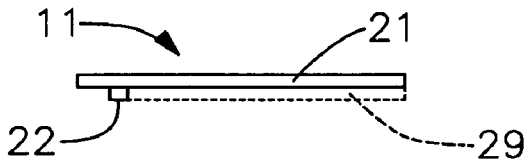
FIG. 10 is a cross-section view on lines 10—10 of FIG. 1.

Referring now to FIGS. 1 and 9 of the drawings, size selectable cover plates 41 and 41A can be seen of a generally rectangular configuration of any decorative nature. The cover plates 41 can be selectively sized to correspond with a gap at 42 left between the assemblies mounted mail box portion 11 and paper receiving tube portion 12 due to the spacing between the mail box opening B and the paper receiving tube opening O. The appropriate cover plate 41 and 41A for the effective size is selected and then positioned thereover and secured to the respective engagement surfaces of the overlapping assemblies.

Alternately, if only a mail box access cover is needed, the mail box portion 11 can be used independently with an appropriate cover plate 41 and 41A providing a decorative cover for the effected area defined between the respective arms 20 and 21 as hereinbefore described for a finished look.

It will be apparent to those skilled in the art that by using a single mail box portion 11 as both the mail box access and paper tube access that the mail box portion will work equally well when positioned over the paper tube opening O and its related insert. It will also be noted that the hereinbefore described guide ribs 22 could be eliminated in such a single mail box portion 11 dual use and simple elongated alignment slots S2 shown in broken lines in FIG. 2 of the drawings can provide the alignment mounting function previously imparted by the guide ribs.

Figure 13:
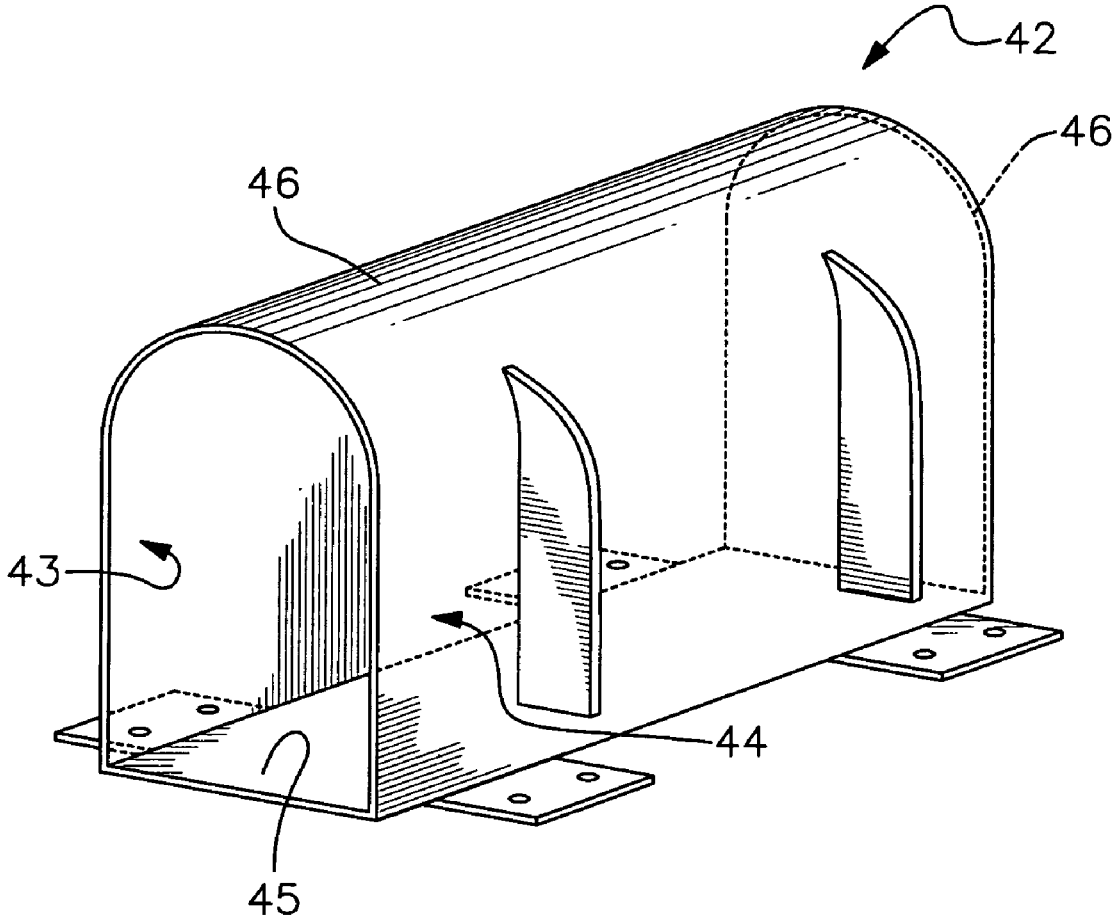
FIG. 13 is a perspective view of a mail box insert for new construction.

Referring now to FIG. 13 of the drawings, a mail box insert 42 can be seen used in combination with the hereinbefore described mail box and paper tube access assembly 10 in the applications of new construction. The mail box insert 42 has oppositely disposed sidewalls 43 and 44 with an integral base 45 and contoured annular integral top panel 46. Back plate 47 is registerably engaged and defines an open end enclosure insert. A plurality of mounting and support flanges 48 and 49 extending from said sidewalls 43, 44 and said base 45 for multiple mounting requirements in construction methods applied and securing the insert 42 into the masonry column M applicable in new construction situations.

Typically, the mail box insert 42 is of synthetic resin material so as to be rust free so that in combination with the hereinbefore described mail box and paper tube assembly 10 of the invention to provide a unique and novel weatherproof and long lasting mail box mounted in a masonry column M.

It will thus be seen that a new and novel mail box and paper tube access assembly 10 has been illustrated and described and it will be apparent to those skilled in the art that various changes and modifications may be made thereto without departing from the spirit of the invention.

I claim:

1. A mail box access assembly for masonry mounted mail boxes comprising, a first base mounting plate secured over a mail box opening of a masonry support structure, a second base mounting plate secured over a paper tube receiving opening of the masonry support structure, said first and second base mounting plates are adjustably secured to one another, said first base mounting plate has a mail box access opening therein, said second base mounting plate having a paper access opening therein and means for adjustably securing said first and second base mounting plates to one another, a mail box door mounting flange frame adjustably secured to said first base mounting plate and a door pivotally attached to said door mounting frame.

2. The mail box access assembly set forth in claim 1 wherein said first base mounting plate has an upstanding flange extending about said mail box access opening.

3. The mail box access assembly set forth in claim 1 wherein said second base mounting plate has an upstanding annular flange about its paper access opening therein.

4. The mail box access assembly set forth in claim 3 wherein said upstanding annular flange about said paper access opening has a paper retainment door assembly registerably positioned thereon.

5. The mail box access assembly set forth in claim 1 wherein a decorative cover plate is registerably secured to said first and second base mounting plates.

6. The mail box access assembly set forth in claim 1 wherein said mail box door mounting frame comprises, an apertured door mounting plate, a plurality of interconnected side and end flanges extending therefrom.

7. The mail box access assembly set forth in claim 1 wherein said means for adjustably securing said first and second base mounting plates to one another comprises, a pair of spaced parallel adjustment arms extending from said first base mounting plate and a pair of spaced parallel adjustment tabs extending from said second base mounting plate aligned for slidable disposition and registration with said spaced parallel arms.

8. The mail box access assembly set forth in claim 7 wherein said adjustment arms have elements thereon for alignment registerable engagement with said spaced parallel adjustment tabs.

9. The mail box access assembly set forth in claim 1 wherein said masonry mounted mail box comprises, a synthetic resin mail box enclosure for positioning within the masonry support structure during construction.

10. The mail box access assembly set forth in claim 9 wherein said synthetic resin mail box enclosure has at least one supporting mounting flange extending therefrom for registration with said masonry support during construction of said masonry support structure.

* * * * *